United States Patent [19]

Dugge et al.

[11] Patent Number: 4,618,295

[45] Date of Patent: Oct. 21, 1986

[54] PLENUM CHAMBER FLOW RESTRICTOR AND CHECK VALVE

[75] Inventors: Richard H. Dugge, St. Louis County; Jan D. Holt, St. Charles County, both of Mo.

[73] Assignee: ACF Industries, Incorporated, Earth City, Mo.

[21] Appl. No.: 644,083

[22] Filed: Aug. 24, 1984

[51] Int. Cl.[4] ..... B65G 53/18

[52] U.S. Cl. ..... 406/138

[58] Field of Search ..... 406/138, 91, 145, 89, 406/90, 127, 132; 222/195; 137/859, 513.3, 516.25

[56] References Cited

U.S. PATENT DOCUMENTS 1,759,983 5/1930 Houston ..... 406/91 X 4,141,379 2/1979 Manske ..... 137/859 X

FOREIGN PATENT DOCUMENTS 1027680 4/1966 United Kingdom ..... 406/138

*Primary Examiner*—Jeffery V. Nase

*Assistant Examiner*—L. E. Williams

*Attorney, Agent, or Firm*—Polster, Polster and Lucchesi

[57] ABSTRACT

The flow restrictor (10) comprises a resilient and flexible porous membrance (12) over an air inlet port (18). In one embodiment an impervious member (130) is attached to the lower surface of the membrane over the air inlet port. The membrane balloons due to air flow through the inlet which greatly increases its effective cross sectional area as air flows into the plenum chamber. When air flow stops gravity and/or air pressure from the container forces the membrane against the seat (118) and the effective cross section of the membrane is reduced to approximately that of the inlet port.

2 Claims, 6 Drawing Figures

PLENUM CHAMBER FLOW RESTRICTOR AND CHECK VALVE

BACKGROUND OF THE INVENTION

Check valves are normally installed in air supply lines to plenum chambers used in fluidized unloading systems. One such check valve is shown at 84 in U.S. Pat. No. 3,708,209 assigned to the same assignee as the present application. Such check valves are positioned to prevent the back flow of air through the air supply if the blower is shut off. This back flow can pressurize the manifold causing a safety hazard if an attendant attempts to disconnect the air inlet or the product discharge line. It can also cause damage to the flower by causing it to rotate in the reverse direction.

The check valves normally used are installed between mounting flanges in the air supply line. See FIG. 6 of U.S. Pat. No. 3,708,209. These valves normally include a spring loaded disc which can be become jammed or can become inoperative if the spring breaks. They must also be fabricated from expensive materials such as stainless steel to prevent corrosion.

Flow restriction is desirable for safety reasons. In the event a primary check valve fails, for example, by breaking of its biasing spring, it is desirable that flow from a plenum chamber or pressurized container will be dissipated slowly, over time, and not rapidly which constitutes a safety hazard to attendants working around the container..

SUMMARY OF THE INVENTION

One object is to provide a flow restrictor which dissipates pressure from within a container slowly over time for safety reasons.

Another object of the present invention is to reduce the cost of check valves used in air supply lines to plenum chambers used in fluidized unloading systems.

Other objects will be apparent from the description and drawings of this application.

The flow restrictor of the present invention comprises a resilient and flexible porous membrane located over an air inlet port. If the restrictor is to function as a sole check valve, a flexible impervious member is attached to the bottom of the membrane in the location where the membrane is located directly over the air inlet port. An air inlet nozzle preferably protrudes through and extends beyond a membrane support plate to provide a valve seat. When air is supplied through the inlet nozzle, pressure on the underside of the membrane causes the membrane to lift off the valve seat, and balloon upwardly, greatly increasing its effective area. The air then passes through the membrane due to the permeability of the membrane. When the inlet air flow is interrupted, air pressure inside the container forces the membrane downward against the valve seat shutting off the flow of air, and reducing its effective area to that extending across the air inlet port.

The membrane should have sufficient permeability to allow air to pass through it in its expanded condition, and be sufficiently impervious that little if any air passes through the membrane when the air pressure is shut off.

In the embodiment where an impervious member is attached to the bottom of the membrane, the impervious member must be of sufficient size to cover the valve seat including fabrication variations, be sufficiently flexible to move with the permeable membrane to the expanded position, and be sufficiently impervious to prevent flow through the seat into the supply conduit. It may function as a sole check valve.

One disadvantage of this embodiment is that the area of the membrane directly above the impervious member is ineffective for fluidization. This will normally be a small area relative to the overall fluidizing area and for most applications, will not affect the performance of the unloading system.

However, to reduce this problem, in another embodiment a second impervious member is also attached to the membrane. It is located generally within the first impervious member and also is located generally above a port in the first membrane.

When air is supplied through the inlet nozzle, the second impervious member is forced away from the first impervious member by air pressure which forces the second impervious member off a seat located on the first impervious member. With this arrangement the dead spot for fluidization is then reduced to the very small area of the second member.

When the air flow is interrupted, air pressure inside the system will force the second member against its seat on the first member. The first member is then forced against its seat on the inlet nozzle, and flow is prevented back into the air supply conduit.

IN THE DRAWINGS

DESCRIPTION OF PREFERRED EMBODIMENTS

U.S. Pat. No. 3,708,209 illustrates an application of a plenum chamber to a railway hopper car container. U.S. Pat. No. 3,708,209 is assigned to the same assignee as the present application, and is hereby incorporated into the present application by this reference.

The flow resistor of the present invention may be utilized with the unloading system shown in U.S. Pat. No. 3,708,209.

Figure 1:
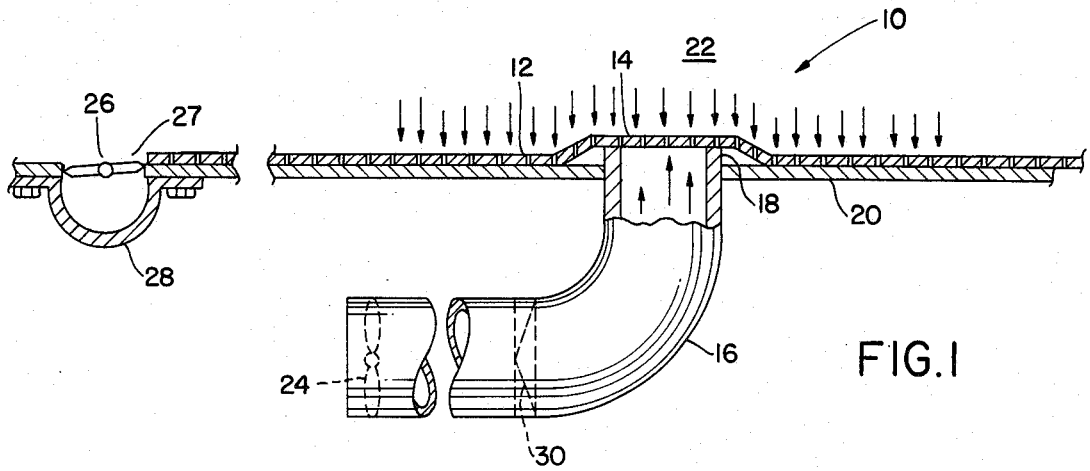
FIG. 1 is a side elevation view of a flow restrictor assembly in accordance with the present invention with the flow restrictor shown in the closed position.

In FIG. 1 of the present application a flow restrictor is indicated generally at 10. This flow restrictor comprises a permeable membrane having a body portion 12 and a seat portion 14. The seat portion 14 is located upon an air inlet conduit 16 which includes an outwardly extending seat portion 18 which extends beyond a membrane support 20. The membrane support 20 defines a part of a plenum chamber 22 utilized to fluidize particulate lading located within the plenum chamber 22. The particulate lading is discharged through a pneumatic outlet 26 of known construction shown substantially in FIG. 1 into a discharge conduit 28. The outlet 26 and discharge conduit 28 do not form a part of the present invention.

Figure 2:
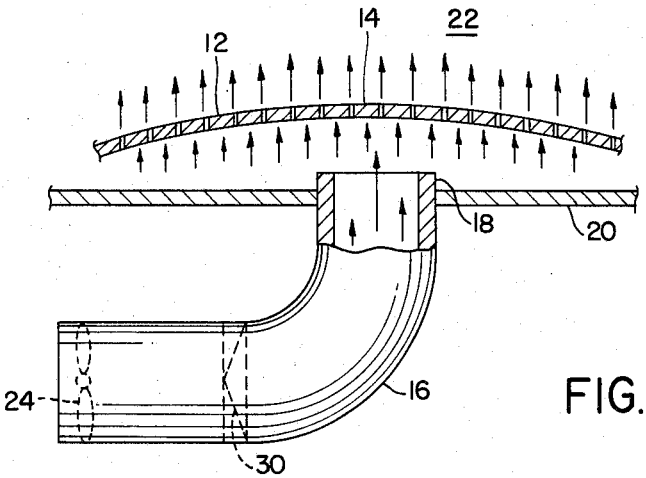
FIG. 2 is a side elevation view similar to FIG. 1 with the flow restrictor shown in the expanded position where air flow may pass through the permeable membrane.

A source of air pressure such as a centrifugal pump 24 is utilized to supply air pressure into the conduit 16. The effect of air pressure being applied to the conduit 16 and through the seat portion 18 causes the permeable membrane 12 to move from the position shown in FIG. 1 to the position shown in FIG. 2. It is seen that in FIG. 2 the air pressure passing through the seat 18 acts on a much greater cross sectional area of the permeable membrane.

The membrane must have sufficient permeability whereby the air will pass through the membrane and into the plenum chamber to allow fluidized pneumatic unloading of the container in a conventional manner. A permeability of at least two cubic feet per minute per square foot in a 2" of water pressure drop should be utilized. Air pressure from the blower 24 is continued until such time as all of the particulate lading is pneumatically unloaded in a normal manner.

After unloading is completed the blower is turned off and the membrane returns to the position shown in FIG. 1. Either gravity and/or integral pressure within the container will cause the membrane to return to the position shown in FIG. 1.

It has been found that the membrane acts as a substantial flow restrictor when it is located in the first position shown in FIG. 1. The affective area upon which internal pressure acts as merely the cross sectional area of the seat 18. This is much, much smaller than the affective area that the membrane assumes in the second position shown in FIG. 2. To achieve effective flow restriction the permeability of the membrane should not exceed about 10 cubic feet per minute per square foot in a 2" of water pressure drop.

The flow restriction has substantial advantages. It is much safer for attendants working about the container if there is little likelihood that the car will depressurize rapidly through this air inlet.

Secondly, if this were to occur, the pump 24 could be harmed by forcing it to turn in the opposite direction.

If the car is to maintain internal pressure it is recommended that a separate check valve shown schematically at 30 be provided to prevent the container from gradually depressurizing. However, the added safety that a rapid depressurization is avoided is believed to make the invention significantly meritorious from a safety point of view even if a separate check valve is provided, because such a check valve could fail in service. If this occurred the present invention would prevent a rapid gas discharge if the container or car were pressurized.

Figure 3:
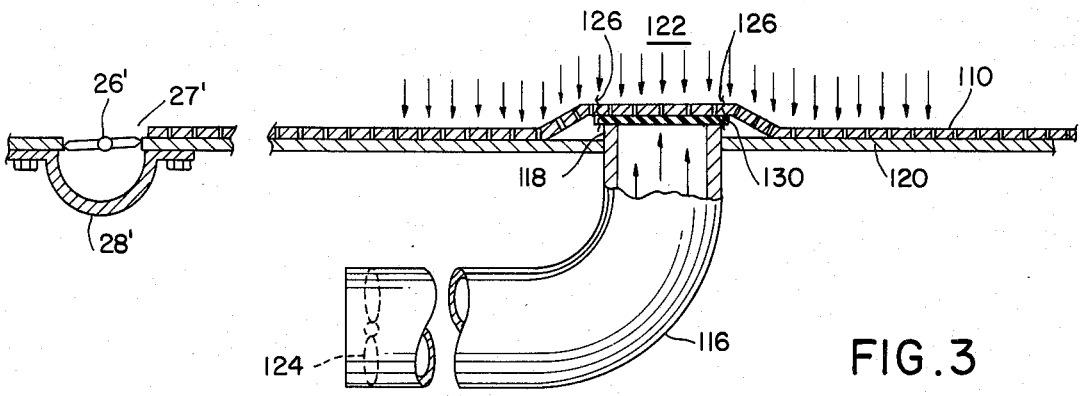
FIG. 3 is a side elevation view of an embodiment of the present invention wherein the flow restrictor utilizes an impervious member and flow into the air supply conduit is significantly reduced.
Figure 4:
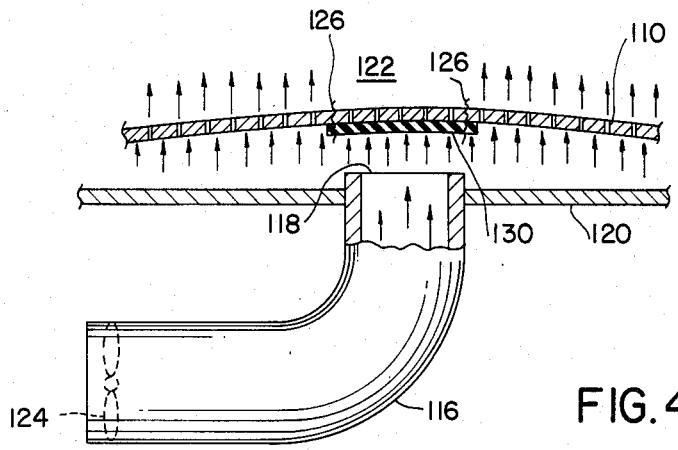
FIG. 4 is a view of the flow restrictor illustrated in FIG. 3 in the expanded position wherein air is seen to pass through the permeable membrane.

Another embodiment of the present invention is illustrated in FIGS. 3 and 4. In this embodiment a permeable membrane 110 is again located upon a membrane support 120. An air inlet conduit 116 includes a seat portion 118 extending outwardly from the membrane support 120.

However, in this embodiment a substantially impervious flexible member 130 is attached to the bottom of the membrane 110. The impervious member 130 should be flexible and at the same time be substantially impervious to flow through it, particularly in a direction from the plenum chamber into the air inlet 116. An example of a suitable material is neoprene rubber. The impervious member is conveniently attached to the permeable member by means of a suitable adhesive or with nylon or other appropriate stitching 126. It is also within the scope of the present invention to use small fasteners, but these fasteners should be located in such a way as to not interfere with the impervious member seating on the seat 110, and preventing flow from the plenum chamber out into the conduit 116.

As was the case in the embodiment shown in FIG. 1, a suitable pump such as a centrifical pump 124 is utilized to apply air pressure to the membrane 110. This air pressure causes the membrane to move from the first position shown in FIG. 3 into the second position shown in FIG. 4. It will be apparent that in the second position shown in FIG. 4 the membrane 110 is spaced from the membrane support 120 and the impervious member 130 is spaced from its seat 118. Thus the flow of air lifts the membrane upwardly and the effective area upon which the air can act to enter the container through the conduit 110 is greatly increased.

Except for the small area where the impervious member 130 is located, the permeable membrane must have sufficient permeability to allow the air to pass therethrough and enter into the plenum chamber 122 to effect pneumatic unloading of the particulate material located in the container. Application of air pressure from the pump 124 continues until such time as pneumatic unloading of the lading has been completed through valve 26' into discharge conduit 28'. When the pump is turned off the permeable membrane 110 returns to the position shown in FIG. 3, and particularly the impervious member 130 reassumes the first seated position shown in FIG. 3. In this position internal pressure from the plenum chamber and/or the container is substantially prevented from entering the conduit 116. Therefore in this embodiment there is no need for a separate check valve in addition to the impervious member 130.

One disadvantage of the embodiment shown in FIGS. 3 and 4 is that there is a significant amount of dead or unused area when the permeable membrane is expanded as shown in FIG. 4. This is because the impervious material 130, of course, does not allow air to pass through it and into the plenum chamber. In one embodiment contemplated for the present invention the pipe 116 is 3" in diameter. Thus an area of $(\pi(3)^2)/4$=about 7 $in^2$ is ineffective for fluidization.

Figure 5:
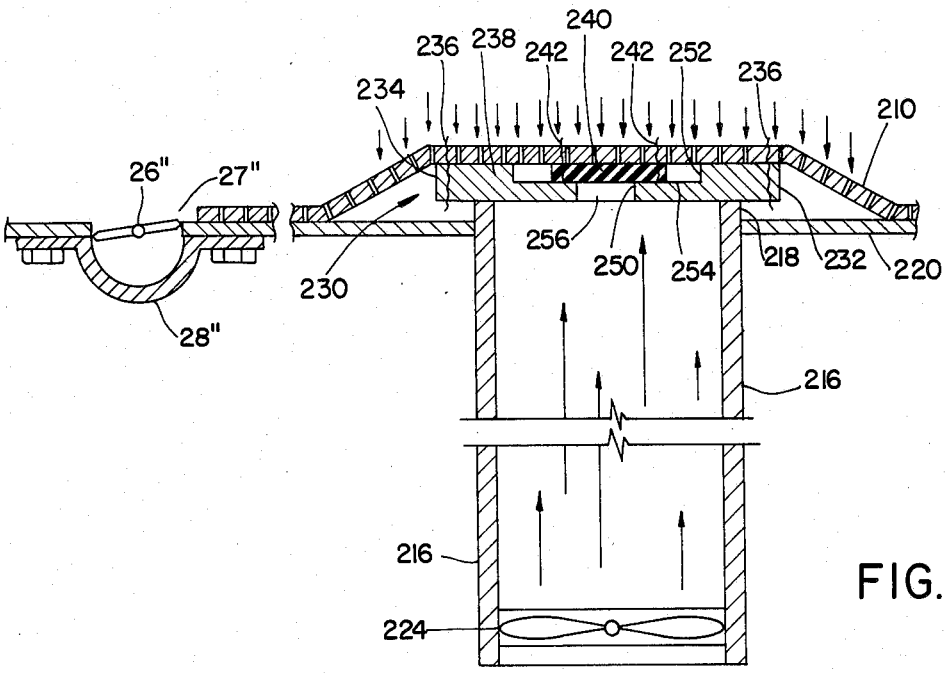
FIG. 5 is a side elevation view of another embodiment of the present invention wherein the cross sectional area of the dead portion of the permeable membrane is reduced through the use of a second impervious member and a seat on the first impervious member.
Figure 6:
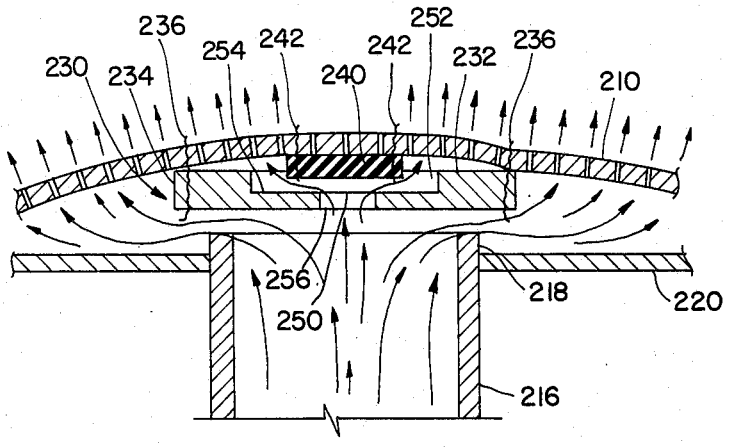
FIG. 6 is a view of the embodiment shown in FIG. 5 with the permeable membrane in expanded position and illustrating the air flow pattern through the permeable membrane both around the first impervious member and through an opening in the first impervious member, and around the second impervious member.

In accordance with the embodiment shown in FIGS. 5 and 6, the amount of area lost in the fluidizing position is substantially reduced. Again in this embodiment a pipe 216 includes an inwardly extending seat portion 218 which extends beyond a support plate 220.

However, in this embodiment a different impervious member 230 is attached to the lower surface of the permeable membrane 210. In this embodiment the impervious member body portion 232 is somewhat thicker than the embodiment illustrated in FIGS. 3 and 4. For example, it may have a thickness of approximately 1". The impervious member is attached to the permeable membrane at its peripheral portion 234 by a suitable adhesive, or in a preferred embodiment with threads 236.

However, in the portion 238 of the impervious member the impervious member is not attached to the permeable membrane 210, and an opening 252 is provided therein 252.

Further an auxiliary impervious member 240 is attached to the permeable membrane generally at the midportion of the cross sectional area of the seat 218. The second impervious member 240 is preferably connected to the permeable membrane throughout its upper surface with a suitable adhesive or with threads indicated at 242 in FIG. 6.

In the first closed position the second impervious member 240 rests upon a seat 250 defined in the midportion of the impervious member 230. This seat is conveniently formed by forming the opening 252 in the impervious member 230 to a vertical extent less than the entire thickness of the impervious member 230. Preferably this cut out portion defines a generally horizontal surface 254. Additional cutting, or through an appropriate molding operation, a second opening 256 is defined through which air may pass when the permeable membrane is in the second expanded position as shown in FIG. 6. As was the case with the other embodiments air under pressure is applied by means of a suitable pump 224. This air pressure first moves the peripheral portion 236 off the seat 218, and lifts the permeable membrane 230 generally vertically. In addition air pressure enters the opening 256 and lifts the secondary impervious member 240 off its seat 254, thereby allowing air to pass around the peripheral portion of the second impervious membrane, and allows air to pass through the permeable membrane 210 in the midportion of the permeable membrane, except for the small cross sectional area occupied by the second impervious member 240. This area is small and may be of the order of $\frac{1}{2}''$ in. diameter, or $\pi(\frac{1}{4})^2$ or $\pi/16$=approx. 0.02 in$^2$. It is thus seen that with the use of the second impervious member 240 that greater use of the cross sectional area of the permeable membrane 210 is achieved.

After the lading has been unloaded and the air pressure from blower 224 is turned off, the second impervious member 240 returns to its seat 254 and the first impervious member returns to its seat 218 on the conduit 216, both in first position.

As an example, the flow restrictor and check valve assembly of the present invention may be utilized in connection with the structure illustrated in U.S. Pat. No. 3,708,209 assigned to the same assignee as the present invention. Permeable membranes 10, 110, and 210 may be utilized instead of permeable membrane 44 disclosed in the U.S. Pat. No. 3,708,209.

The embodiment shown in FIGS. 3 and 4; and 5 and 6 for most applications will eliminate the need for the check valve 84 in the patent shown at FIG. 6.

A preferred application of the present invention is to unload a railway hopper car indicated at 10 in the U.S. Pat. No. 3,708,209 patent through the discharge opening 52 and through the discharge conduit 56. This patent may be referred to for additional construction details concerning the outlet assembly and the technique used for unloading.

What is claimed is:

1. A flow restrictor, comprising:

a fixed wall; an air inlet nozzle extending through said wall and defining a membrane valve seat; a resilient and flexible porous membrane located over said wall and over said valve seat in a first position; a flexible impervious member attached to a surface of the membrane such that when the membrane is in said first position, the impervious member is located over the valve seat such that air from said air inlet is substantially only in operative communication with the air impervious member; whereby when air is supplied through the inlet nozzle between the wall and the membrane, pressure on the side of the membrane between the wall and the membrane causes the membrane to lift off the valve seat to a second position, thereby increasing its area in operative communication with air pressure between the membrane and the wall; and whereby in said second position air passes through the membrane at least in that portion of the membrane not occupied by the impervious member; and whereby when air flow through said air inlet nozzle is interrupted gravity and/or air pressure forces the impervious member downward against said valve seat reducing its operative area substantially to that extending across the air inlet nozzle and substantially shutting off the flow of air into said air inlet nozzle, wherein said impervious member contains an opening and a second impervious member is located within said opening and is located generally above said seat and is also attached to said membrane.

2. A flow restrictor according to claim 1, wherein said first impervious member opening extends only part way throughout the thickness of said first impervious member, and wherein said member defines a generally horizontally extending surface which extends inwardly and defines a second valve seat for said second impervious member, and wherein a second opening is defined by said first impervious member below said second impervious member, whereby when air pressure is applied to said flow restrictor, said first impervious member moves off its seat and outwardly from its seat; air pressure passes through said second opening and forces said second impervious member off said second seat; whereby air may pass around said second impervious member and through said porous membrane; and whereby additional air may pass around said first impervious member and through said membrane outboard of said first impervious member; and whereby when air pressure is shut off the first impervious membrane returns to its seat and the second impervious membrane returns to said second seat and flow is essentially prevented from taking place in a direction opposite to the first flow direction.

* * * * *